US008440605B2

(12) United States Patent
Wise

(10) Patent No.: US 8,440,605 B2
(45) Date of Patent: May 14, 2013

(54) PROCESS FOR MAKING A CLEANING COMPOSITION EMPLOYING DIRECT INCORPORATION OF CONCENTRATED SURFACTANTS

(75) Inventor: Geoffrey Marc Wise, Reading, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/795,990

(22) Filed: Jun. 8, 2010

(65) Prior Publication Data

US 2011/0053826 A1 Mar. 3, 2011

Related U.S. Application Data

(60) Provisional application No. 61/184,953, filed on Jun. 8, 2009.

(51) Int. Cl.
*C11D 11/00* (2006.01)
*C11D 1/29* (2006.01)

(52) U.S. Cl.
USPC ..... 510/422; 510/119; 510/127; 510/130; 510/135; 510/138; 510/146; 510/155; 510/156; 510/417; 510/427; 510/428

(58) Field of Classification Search ..... 510/119, 510/127, 130, 135, 138, 146, 155, 156, 417, 510/422, 427, 428
See application file for complete search history.

(56) References Cited

U.S. PATENT DOCUMENTS

| | | | | |
|---|---|---|---|---|
| 3,249,550 | A | 5/1966 | Metters | |
| 3,616,859 | A | 11/1971 | Shay et al. | |
| 4,024,078 | A | 5/1977 | Gilbert et al. | |
| 4,294,728 | A | 10/1981 | Vanlerberghe et al. | |
| 4,753,754 | A | 6/1988 | Messenger | |
| 4,980,078 | A | 12/1990 | Verite et al. | |
| 5,021,195 | A * | 6/1991 | Machin et al. | 510/397 |
| 5,077,042 | A | 12/1991 | Darkwa et al. | |
| RE34,584 | E | 4/1994 | Grote | |
| 5,440,032 | A | 8/1995 | Hirosawa et al. | |
| 5,482,543 | A | 1/1996 | Bleve et al. | |
| 5,580,850 | A | 12/1996 | Bigorra | |
| 5,599,784 | A * | 2/1997 | Bainbridge | 510/417 |
| 5,610,127 | A | 3/1997 | Erilli et al. | |
| 5,635,466 | A | 6/1997 | Burdon | |
| 5,695,748 | A | 12/1997 | Francis | |
| 5,741,948 | A | 4/1998 | Kirishiki et al. | |
| 5,750,099 | A | 5/1998 | Yoshihara et al. | |
| 5,814,323 | A | 9/1998 | Lyle | |
| 5,906,972 | A | 5/1999 | Gabriel et al. | |
| 5,942,485 | A | 8/1999 | Kemen | |
| 5,958,868 | A | 9/1999 | Pi Subirana | |
| 5,994,595 | A | 11/1999 | Onda et al. | |
| 6,074,633 | A | 6/2000 | Dubief et al. | |
| 6,150,322 | A | 11/2000 | Singleton et al. | |
| 6,207,629 | B1 | 3/2001 | Gonzalez et al. | |
| 6,399,045 | B1 | 6/2002 | Morgan et al. | |
| 6,417,408 | B2 | 7/2002 | Onda et al. | |
| 6,432,420 | B2 | 8/2002 | Ellis et al. | |
| 6,471,953 | B1 | 10/2002 | N'Guyen et al. | |
| 6,706,931 | B2 | 3/2004 | Edwards | |
| 6,849,252 | B1 | 2/2005 | Yang | |
| 6,884,275 | B2 | 4/2005 | Okada et al. | |
| 6,946,437 | B2 | 9/2005 | Aizawa et al. | |
| 7,208,480 | B2 | 4/2007 | Williams et al. | |
| 7,666,825 | B2 | 2/2010 | Wagner et al. | |
| 2002/0041854 | A1 | 4/2002 | Hadasch et al. | |
| 2002/0122772 | A1 | 9/2002 | Lukenbach et al. | |
| 2002/0151738 | A1 | 10/2002 | Edwards | |
| 2003/0083210 | A1 | 5/2003 | Goldberg et al. | |
| 2004/0092413 | A1 | 5/2004 | Ticktin | |
| 2004/0116539 | A1 | 6/2004 | Biercevicz | |
| 2004/0166071 | A1 | 8/2004 | Pfaffernoschke et al. | |
| 2004/0166074 | A1 | 8/2004 | Darkwa | |
| 2004/0235689 | A1 | 11/2004 | Sakai et al. | |
| 2004/0254253 | A1 | 12/2004 | Culeron | |
| 2004/0266652 | A1 | 12/2004 | Brown et al. | |
| 2004/0266656 | A1 | 12/2004 | Sakurai | |
| 2005/0063934 | A1 | 3/2005 | Baker | |
| 2005/0166338 | A1 | 8/2005 | Arango | |
| 2005/0192196 | A1 | 9/2005 | Hutton | |
| 2005/0239669 | A1 * | 10/2005 | Krzysik et al. | 510/130 |
| 2005/0241076 | A1 | 11/2005 | Bureiko et al. | |
| 2006/0024256 | A1 | 2/2006 | Wells | |
| 2006/0078528 | A1 | 4/2006 | Yang et al. | |
| 2006/0078529 | A1 | 4/2006 | Uchida | |
| 2006/0083703 | A1 | 4/2006 | Torgerson | |

(Continued)

FOREIGN PATENT DOCUMENTS

| | | | |
|---|---|---|---|
| DE | 19534372 | A1 | 9/1995 |
| EP | 336803 | B1 | 9/1992 |
| EP | 0573329 | B1 | 7/1997 |
| EP | 0834307 | A2 | 4/1998 |
| EP | 1 009 787 | B1 | 6/2000 |
| EP | 1696023 | B1 | 4/2008 |
| EP | 1 572 333 | B1 | 5/2008 |
| JP | 56001895 | A | 1/1981 |
| JP | 58006209 | A | 1/1983 |
| JP | 63143935 | A2 | 6/1988 |
| JP | 6107888 | A | 4/1994 |
| JP | 07034089 | A | 2/1995 |
| JP | 09249900 | A | 9/1997 |
| JP | 2002-038200 | A | 2/2002 |

(Continued)

OTHER PUBLICATIONS

U.S. Appl. No. 12/794,240, filed Jun. 4, 2010, Hutton, III.
Translation of Continuous Dilution of Concentrated Alkyl Ether Sulfates Soaps-Oils-Fats-Waxes, vol. 103, No. 16, 1977, pp. 465-466.
XP002545441, Thomson, 1 page.
XP002545442, Thomson, 1 page.

*Primary Examiner* — Charles Boyer
(74) *Attorney, Agent, or Firm* — Carl J. Roof

(57) ABSTRACT

The proposed process of the present application passes a concentrated surfactant in a lamellar phase though a high-shear device diluting the concentrated surfactant in a lamellar phase to an isotropic phase without encountering the highly viscous middle phase.

17 Claims, 1 Drawing Sheet

U.S. PATENT DOCUMENTS

| | | | | |
|---|---|---|---|---|
| 2006/0083704 | A1 | 4/2006 | Torgerson | |
| 2006/0128596 | A1 | 6/2006 | Koshti et al. | |
| 2006/0251605 | A1 | 11/2006 | Belmar et al. | |
| 2006/0286060 | A1 | 12/2006 | Yang | |
| 2007/0014823 | A1 | 1/2007 | Iwata | |
| 2007/0041929 | A1 | 2/2007 | Torgerson | |
| 2007/0119864 | A1 | 5/2007 | Tsai | |
| 2007/0141001 | A1* | 6/2007 | Clapp et al. | 424/63 |
| 2007/0215642 | A1 | 9/2007 | Van der Heijden | |
| 2007/0286837 | A1 | 12/2007 | Torgerson | |
| 2008/0085961 | A1* | 4/2008 | Lin | 524/313 |
| 2008/0139434 | A1* | 6/2008 | Basappa et al. | 510/159 |
| 2008/0153730 | A1 | 6/2008 | Tsaur et al. | |
| 2009/0155383 | A1 | 6/2009 | Kitko | |
| 2009/0221463 | A1 | 9/2009 | Kitko | |
| 2009/0227482 | A1 | 9/2009 | Dong et al. | |
| 2009/0324527 | A1 | 12/2009 | Okada | |
| 2009/0324528 | A1 | 12/2009 | Okada | |
| 2009/0324529 | A1 | 12/2009 | Okada | |
| 2009/0324530 | A1 | 12/2009 | Yang | |
| 2009/0324531 | A1 | 12/2009 | Okada | |
| 2009/0324532 | A1 | 12/2009 | Okada | |
| 2010/0143280 | A1 | 6/2010 | Yokogi | |
| 2010/0143281 | A1 | 6/2010 | Okada | |
| 2010/0143282 | A1 | 6/2010 | Yokogi | |
| 2010/0143425 | A1 | 6/2010 | Okada | |
| 2011/0048449 | A1 | 3/2011 | Hutton | |

FOREIGN PATENT DOCUMENTS

| | | | |
|---|---|---|---|
| JP | 2003205039 | | 7/2003 |
| JP | 2005113067 | A | 4/2005 |
| JP | 2005232118 | | 9/2005 |
| JP | 2005255627 | A2 | 9/2005 |
| WO | WO98/57615 | | 12/1998 |
| WO | WO99/62492 | A1 | 12/1999 |
| WO | WO0000170 | | 1/2000 |
| WO | WO0040213 | A1 | 7/2000 |
| WO | WO0117492 | A1 | 3/2001 |
| WO | WO2004054693 | A1 | 7/2004 |
| WO | WO2005070374 | A1 | 8/2005 |
| WO | WO2005074868 | A1 | 8/2005 |
| WO | WO2010052092 | A1 | 5/2010 |

* cited by examiner

PROCESS FOR MAKING A CLEANING COMPOSITION EMPLOYING DIRECT INCORPORATION OF CONCENTRATED SURFACTANTS

CROSS REFERENCE TO RELATED APPLICATION

This application claims the benefit of U.S. Provisional Application Ser. No. 61/184,953, filed Jun. 8, 2009.

FIELD OF THE INVENTION

The present invention describes a process for making a cleaning composition employing direct incorporation of concentrated surfactants.

BACKGROUND OF THE INVENTION

Many common surfactants used in cleaning compositions are difficult to handle in concentrated form. In particular, it is well-known that some surfactants such as alkyl sulfates and alkyl ether sulfates exhibit a prohibitively viscous gel phase or "middle phase" for aqueous concentrations in the range of roughly 30% to 60% by weight surfactant, while exhibiting a thick but flowable lamellar phase at somewhat higher concentrations.

To save on transportation and storage costs, it is preferable to handle these materials in a concentrated form. However, in order to dilute the lamellar phase into the isotropic phase, care must be taken to avoid generation of the middle phase or mesophase. Once the middle phase is formed, it can take hours to days to dilute this high-viscous phase further due to the slow mixing dynamics, rendering dilution of the lamellar phase via simple impeller mixing as impractical on an industrial scale. Often, a high-energy device is employed to break up local regions of intermediate compositions before they can form the difficult middle phase, and care must be taken in the order of ingredient addition to avoid compositions that lie in the middle phase.

Several approaches have been disclosed in the art for adding a second material to the lamellar surfactant to mitigate the middle phase, usually a hydrotrope such as that discussed in U.S. Pat. No. 5,635,466, but other surfactants such as that discussed in U.S. Pat. No. 5,958,868 and micronized air such as that discussed in JP 2002-038200A have also been disclosed to be effective in some narrow applications.

In most cases, where the addition of another material to mitigate the middle phase is not desirable, the common solution is to dilute the lamellar phase very carefully into water using a specialized dilutor, such as a Bran-Luebbe as disclosed in Seifen, Oele, Fette, Wachse (1977), 103(16), 465-6 CODEN: SOFWAF: ISSN 0173-5500. In this operation, specialized pumps deliver the water and lamellar surfactant at a precise flow ratio into a high-shear device to dilute the surfactant to a fixed concentration, typically ~25%. This approach of high-shear dilution into water can be extended to lamellar surfactant blends as discussed in US 2008/0139434A1; however, using this blend unnecessarily fixes the compositional ratio of the blended surfactants across all the products to be made at a particular location. Very specialized pumps are required due to the low viscosity of the water phase, the high viscosity of the surfactant phase, and the need to strictly avoid flow ratios resulting in a composition in the middle phase of the phase diagram. In fact, in some situations, the need for a specialized dilution system outweighs the cost savings of transporting the surfactant in the high-active form to the cleaning-product manufacturing facility, and thus the surfactant is created only in the diluted form.

It is of interest to note that in all lamellar surfactant dilution processes disclosed in the art, the diluting medium is primarily water, presumably because other ingredients present in the aqueous phase can alter the phase chemistry and mixing dynamics in unpredictable ways. Particularly when making compositions at low final surfactant concentrations, the separation of the dilution step is a logical choice to reduce the uncertainty of the operation. However, there are situations in which having other ingredients present in substantial quantities in the aqueous phase during the surfactant dilution is actually preferred.

It has been surprisingly found that many of the common ingredients in cleaning compositions are actually not barriers to successful dilution of the concentrated lamellar surfactant, provided that care is taken to control of the flow ratio in the dilution operation. In fact, the viscosity-building aspect of these aqueous ingredients can improve the control of the flow ratio that is critical to avoiding mesophase production. The key breakthrough to implementing in the invention is the understanding of the influence of the aqueous phase comprising more than just water on the surfactant phase behavior, and therefore the range of flow ratios which leads to an acceptable cleaning composition or base for a cleaning composition exiting the mixing device.

The present invention eliminates the need for a separate dilution operation and allows for maximum flexibility in the relative compositions of various components in the cleaning composition. The skilled practitioner will recognize that the process described herein allows water that would normally be used strictly for dilution of the lamellar phase to be used for other purposes, such as polymer hydration or easier mixing of the other components into the cleaning composition. In some situations, the process may also allow for lower-temperature processing to achieve the final cleaning composition. Additionally, when a high concentration of surfactant is desired in the final cleaning composition, the present process improves on the current art by allowing for higher levels of other ingredients to be included in a cleaning composition and delayed addition of those ingredients, thereby enabling a wider range of possible formulas and operational logistics at the manufacturing facility. Later addition of ingredients into the process can be helpful for shear-sensitive ingredients and for improving operational logistics when making several products that differ only slightly from each other.

SUMMARY OF THE INVENTION

The present application relates to a process for making liquid cleaning compositions comprising the steps of providing an aqueous phase comprising water and at least one other component selected from anionic surfactants, co-surfactants, conditioning polymers, deposition polymers, providing a surfactant in a lamellar phase wherein the lamellar phase comprises from about 50% to 80% active surfactant(s) in the lamellar phase; combining the aqueous phase with the lamellar phase in a high shear device at a flow ratio of the aqueous phase to lamellar phase such that a liquid cleaning composition results wherein the liquid cleaning composition is homogeneous at a length scale of 1 mm and comprises a viscosity of less than 100 Pa-s at a shear rate of 1/sec.

DETAILED DESCRIPTION OF THE INVENTION

Figure 1:
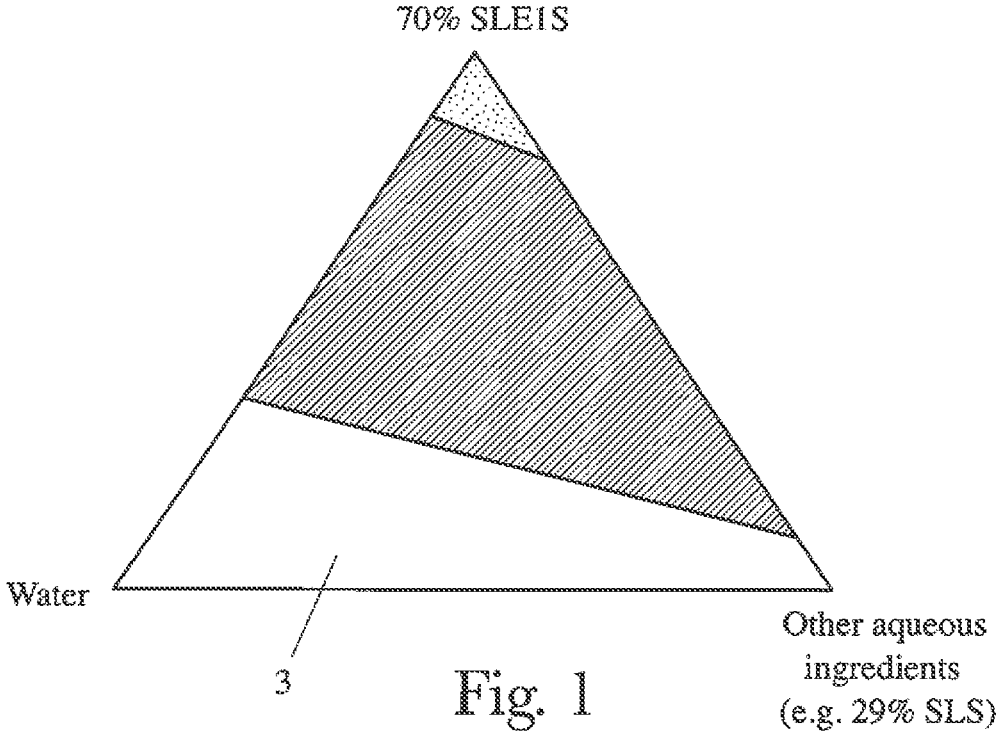
FIG. 1 is a phase diagram for water, 29% sodium lauryl sulfate, and (lamellar) 70% sodium laureth-1 sulfate.

The proposed process of the present application passes a concentrated surfactant in a lamellar phase though a high-shear device diluting the concentrated surfactant in a lamellar phase to an isotropic phase without encountering the highly viscous middle phase.

Moreover, it has been found that in the proposed process with careful control of the flow ratios of aqueous to lamellar phases, the lamellar phase can be diluted via high-energy mixing directly into the cleaning composition; i.e. the concentrated surfactant in a lamellar phase stream is combined with an aqueous phase stream that already contains components other than water. In fact, the presence of the non-water components in the aqueous phase improves the pump-ability of the aqueous phase, widening the range of equipment that is capable of executing the critical dilution operation, such that the dilution step can be carried out on equipment shared with other, more routine plant operations.

The key to the invention is the determination of the influence of these non-water aqueous phase components on the flow ratios that lead to successful dilution. This is preferably determined using the actual equipment intended to make the product, or on a scaled-down version of the production facility, as is commonly found in a research laboratory. The approach, as will be illustrated in a later example, is to pump the proposed aqueous phase and the lamellar surfactant into the high-shear mixing device at different flow ratios of aqueous to lamellar phase. The compositions exiting the mixer are then collected and analyzed to determine the success of the dilution experiment for each flow ratio under consideration.

By successful dilution, it is meant that the stream resulting from the combination of the aqueous stream and the concentrated surfactant lamellar phase stream is homogeneous at a length scale of 1 mm, and exhibits a viscosity of less than 100 Pa-s at a shear rate of 1/sec, so as to be sufficiently flowable for downstream processing operations. A minimum energy will be required to achieve the desired homogeneity, and the skilled practitioner will recognize that this minimum energy will depend on the high-energy mixer used as well as the composition under study. The temperature at which viscosity is measured is best assessed at the temperature of the dilution operation in the production line during manufacture. For cases in which the two incoming streams are at different temperatures, such as to promote the flowability of one of the constituent phases (e.g., high melting point components), the proper temperature is that of the combined composition. For example, a process run at room temperature would have a viscosity measured at 25° C. An elevated processing temperature would result in the viscosity being measured at a temperature above 25° C., for example 40° C.

The practitioner skilled in the art will recognize that the invention can work over a range of flow ratios, but it is often desirable, particularly for more concentrated cleaning compositions, to keep the ratio as low as possible to minimize the amount of aqueous phase required for the dilution process. We therefore define a "minimum flow ratio" (MFR) as the ratio that just meets the viscosity threshold described in the preceding paragraph.

In one embodiment, the flow ratio can be determined for a cleaning formulation comprising high levels of surfactants (more than 20 wt % by weight of the composition). FIG. 1 shows the phase behavior for the mixture of 70% sodium laureth-1 sulfate (SLE1S), 29% sodium lauryl sulfate, and water, drawn on an as-added basis.

From the FIG. 1 representation of a three-part mixture of water, 29% sodium lauryl sulfate, and (lamellar) 70% sodium laureth-1 sulfate, it can be seen that over a range of compositions, a gel phase forms. This "middle phase" (1) is highly viscous and difficult to dissolve, requiring excess energy and time to be expended in the production process if this phase is encountered. Other phases include lamellar (2) and isotropic (3) phases. In one embodiment of the process described herein SLE1S is introduced to the aqueous phase mixture in such a manner as to avoid the "middle phase."

The active concentration of surfactant in the high-shear device must be less than the boundary between isotropic and mesophase; again, this boundary may depend strongly on the levels of some of the aqueous phase ingredients. Conversely, if the flow ratio is too dilute in surfactant (more water), it is not possible to achieve the desired activity of the surfactant in the final product. Typically, the flow ratio into the high-shear device will be between 1.0 and 3.0 of the MFR for the composition under consideration.

Figure 2:
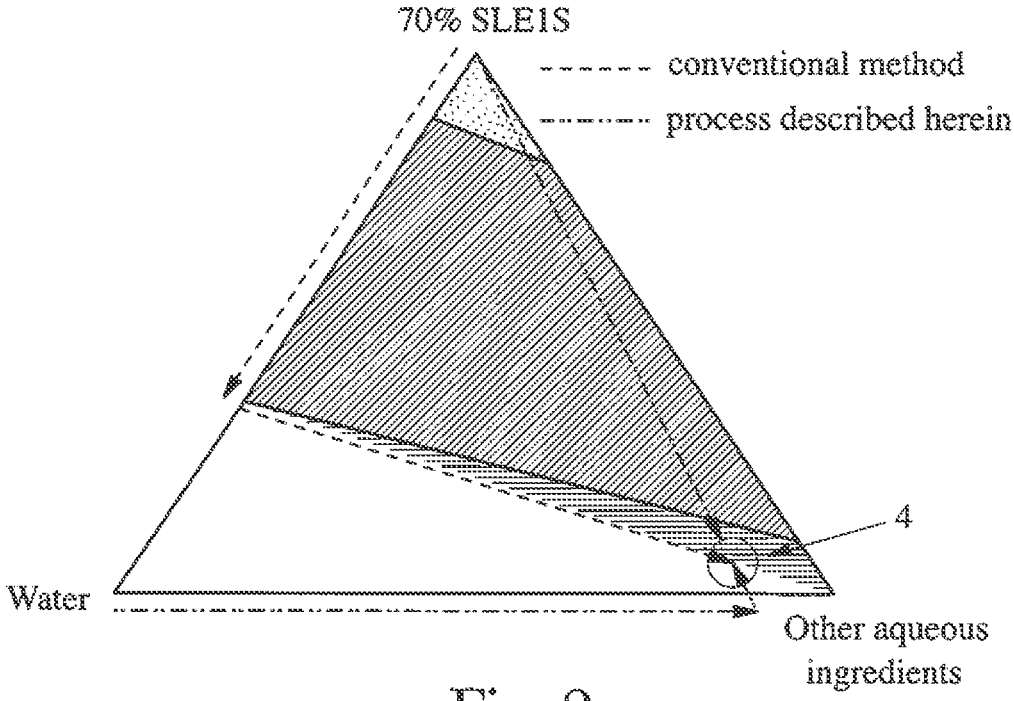
FIG. 2 is the phase diagram of FIG. 1 wherein the theoretical movement within the phase diagram is shown for known processes and the process described and claimed herein.

Note in FIG. 2 how the present process compares to prior process in the dilution of surfactants and the process described herein enables some high-surfactant compositions (more than 20 wt % by weight of the composition) (4) that are not attainable using the conventional method of first diluting the lamellar surfactant.

As used herein a "high-shear device" as one that imparts a minimum of, say, 3 kJ/kg of energy density to the mixture as it passes through the device. For a rotating device (e.g. IKA rotor-stator mill), this can be calculated roughly by dividing the power draw by the mass flowrate. For a static device (e.g., static mixer or SONOLATOR®), the energy level can be calculated as the pressure loss across the device divided by the material density. In one embodiment the high-shear device is a rotor/stator mill or similar dynamic mixer, in which the fluid passes through a gap from about 0.1 mm to about 20 mm, and the tip speed of rotation may be set from about 5 to about 50 meters per second. In another embodiment the high-shear device is selected as a static mixer, by which is meant a mixing device whose energy dissipation results naturally from the flow of the material through the device wherein the energy density imparted through the device is 10-10,000 J/kg.

In one embodiment the described process occurs in a single pass through the mixing device. In another embodiment, the lamellar surfactant is added to a recirculation line, in which the output of the high-shear device is collected and re-circulated into the high-shear device in a controlled flow ratio with additional lamellar surfactant. In another embodiment, the lamellar surfactant is added in a recirculation line. In another embodiment, the aqueous phase is at least partially added in the recirculation line. In another embodiment the aqueous phase is at least partially passed through the high shear device and at least partially added to the liquid cleaning composition after the high shear device.

The cleaning compositions resulting from the process described herein are of value as concentrated cleaning compositions. As used herein "concentrated" means that the resulting cleaning composition of the present process provides equal or better performance than traditional cleaning compositions of a similar nature at one-half to one-third the usage level.

Suitable cleaning composition includes hair cleaning compositions such as shampoo, body wash compositions and hand soap compositions.

Although the invention can reduce or eliminate the need for hydrotropes to mitigate the middle phase, the skilled practitioner will recognize that the invention can be used in conjunction with a hydrotrope present in either phase, or as a later add to control the final product viscosity. The influence of the hydrotrope on the phase diagram and the MFR can be assessed with the same technique described above. As used herein, the terms "organic solvent" and "hydrotrope" encompass those materials recognized in the art as organic solvents or hydrotropes. Examples of organic solvents include those used in cleansing applications, and can be selected from the group consisting of alcohols, glycols, ethers, ether alcohols, and mixtures thereof. Typical hydrotropes can include cumene, xylene and toluene sulfonates, and mixtures thereof. Both solvent and hydrotrope examples are generally described in McCutcheon's, Detergents and Emulsifiers, North. American edition (1986), published by Allured Publishing Corporation; and in McCutcheon's Functional Materials, North American Edition (1992).

Concentrated Surfactant in a Lamellar Phase

The concentrated surfactant in a lamellar phase suitable for use herein include alkyl and alkyl ether sulfates of the formula $ROSO_3M$ and $RO(C_2H_4O)_xSO_3M$, wherein R is alkyl or alkenyl of from about 8 to about 18 carbon atoms, x is 1 to 10, and M is a water-soluble cation such as ammonium, sodium, potassium, and triethanolamine cation or salts of the divalent magnesium ion with two anionic surfactant anions.

The alkyl ether sulfates may be made as condensation products of ethylene oxide and monohydric alcohols having from about 8 to about 18 carbon atoms. The alcohols can be derived from fats, e.g., coconut oil, palm oil, palm kernel oil, or tallow, or can be synthetic.

Examples of additional anionic surfactants suitable for use herein include, but are not limited to, ammonium lauryl sulfate, ammonium laureth sulfate, triethylamine lauryl sulfate, triethylamine laureth sulfate, triethanolamine lauryl sulfate, triethanolamine laureth sulfate, monoethanolamine lauryl sulfate, monoethanolamine laureth sulfate, diethanolamine lauryl sulfate, diethanolamine laureth sulfate, lauric monoglyceride sodium sulfate, sodium lauryl sulfate, sodium laureth sulfate, potassium laureth sulfate, sodium lauryl sarcosinate, sodium lauroyl sarcosinate, lauryl sarcosine, cocoyl sarcosine, ammonium cocoyl sulfate, ammonium lauroyl sulfate, sodium cocoyl sulfate, sodium lauroyl sulfate, potassium cocoyl sulfate, potassium lauryl sulfate, monoethanolamine cocoyl sulfate, sodium trideceth sulfate, sodium tridecyl sulfate, sodium methyl lauroyl taurate, sodium methyl cocoyl taurate, sodium lauroyl isethionate, sodium cocoyl isethionate, sodium laurethsulfosuccinate, sodium laurylsulfosuccinate, sodium tridecyl benzene sulfonate, sodium dodecyl benzene sulfonate, and mixtures thereof.

In one embodiment, an ammonium laureth sulfate or sodium laureth sulfate is utilized wherein the condensation products of the ethylene oxide results in an average of 0.7 to 3 moles ethoxy moiety per molecule. In one embodiment, the average of 1 mole of ethoxy moiety per molecule of the ammonium laureth sulfate or sodium laureth sulfate is selected.

Aqueous Phase Composition

In addition to water, the aqueous phase comprises other components in a cleaning composition such as additional anionic surfactants, conditioning polymers, deposition polymers, co-surfactants, conditioning agents, structurants, opacifiers, perfumes or other optional ingredients.

In one embodiment, the composition comprises from about 3 wt % to about 40 wt %, alternatively from about 5 wt % to about 25 wt %, alternatively from about 10 wt % to about 20 wt %, alternatively from about 3 wt % to about 15 wt %, and alternatively from about 3 wt % to about 10% wt by weight of the composition, of an anionic surfactant (other than the concentrated surfactant in the lamellar phase).

The anionic surfactant includes, but is not limited to: branched and non-branched versions of decyl and undecyl alkyl sulfates which are either ethoxylated or non-ethoxylated; decyl alcohol modified lauryl sulfate; paraffin sulfonates with chain lengths ranging from $C_{13}$ to $C_{17}$ sold by the Clariant Company; mixtures of linear and branched-chain alcohol sulfates with carbon chain lengths $C_{12}$ to $C_{17}$ commonly known as LIAL® and NEODOL® alkyl or alcohol sulfates which are ethoxylated or non-ethoxylated; sodium salts of hydroxyethyl-2-dodecyl ether sulfates, or of hydroxyethyl-2-decyl ether sulfates (from Nippon Shokubai Inc., and either or both referred to herein as "NSKK ethoxy sulfate"); monoethoxylated lauryl alkyl sulfates; and mixtures thereof.

Conditioning Polymer

The conditioning polymer suitable herein for the aqueous phase may contain a cationic polymer. A suitable cationic polymer will have a cationic charge density of at least about 0.3 meq/gm, typically at least about 0.5 meq/gm, commonly at least about 0.7 meq/gm, but also generally less than about 7 meq/gm, typically less than about 5 meq/gm, at the pH of intended use of the cleaning composition. The pH of intended use of the composition generally ranges from about pH 3 to about pH 9, typically from about pH 4 to about pH 8. A suitable cationic polymer will generally have an average molecular weight ranging from about 1,000 to about 10,000,000, typically from about 10,000 to about 5,000,000, commonly about 20,000 to about 2,000,000. All molecular weights as used herein are weight average molecular weights expressed as grams/mole, unless otherwise specified.

The weight average molecular weight may be measured by gel permeation chromatography ("GPC") using an Alliance HPLC (Waters 2695 Separation Module) with two hydrogel columns in series (Waters Ultrahydrogel Linear 6-13 um, 7.8×300 nm GPC column, part number 011545) at a column temperature of 30° C. and at a flow rate of 0.9 ml/min, and using a Viscotek Model 300 TDA (triple detector array), light scattering detector (single angle, 90°), viscosity detector, and refractive index detector, all at detector temperatures of 30° C., with a method created by using pullulan narrow standard P-800 from American Polymer Standards Corporation ($M_w$, =788,000), with an injection volume of 25 to 100 μl, and using a dn/dc of 0.147. Additional details on measuring the weight average molecular weight according to a GPC method are described in U.S. Publication No. 2003/0154883 A1.

The term "charge density", as used herein, refers to the ratio of the number of positive charges on a monomeric unit of which a polymer is comprised to the molecular weight of said monomeric unit. The charge density multiplied by the polymer molecular weight determines the number of positively charged sites on a given polymer chain.

Suitable cationic polymers may contain cationic nitrogen-containing moieties such as quaternary ammonium or cationic protonated amino moieties. The cationic protonated amines can be primary, secondary, or tertiary amines (typically secondary or tertiary), depending upon the particular species and the selected pH of the composition. Any anionic counterions can be used in association with the cationic polymers so long as the polymers remain soluble in water, in the cleaning composition, or in a coacervate phase of the cleaning composition, and so long as the counterions are physically and chemically compatible with the components of the cleaning composition or do not otherwise unduly impair product performance, stability or aesthetics. Non-limiting examples of such counterions include halides (e.g., chloride, fluoride, bromide, iodide), sulfate and methylsulfate.

Non-limiting examples of such polymers are described in the CTFA Cosmetic Ingredient Dictionary, 3rd edition, edited by Estrin, Crosley, and Haynes, (The Cosmetic, Toiletry, and Fragrance Association, Inc., Washington, D.C. (1982)). Non-limiting examples of suitable cationic polymers include copolymers of vinyl monomers having cationic protonated amine or quaternary ammonium functionalities with water soluble spacer monomers such as acrylamide, methacrylamide, alkyl and dialkyl acrylamides, alkyl and dialkyl methacrylamides, alkyl acrylate, alkyl methacrylate, vinyl caprolactone or vinyl pyrrolidone.

Suitable cationic protonated amino and quaternary ammonium monomers, for inclusion in the cationic polymers of the composition herein, include vinyl compounds substituted with dialkylaminoalkyl acrylate, dialkylaminoalkyl methacrylate, monoalkylaminoalkyl acrylate, monoalkylaminoalkyl methacrylate, trialkyl methacryloxyalkyl ammonium salt, trialkyl acryloxyalkyl ammonium salt, diallyl quaternary ammonium salts, and vinyl quaternary ammonium monomers having cyclic cationic nitrogen-containing rings such as pyridinium, imidazolium, and quaternized pyrrolidone, e.g., alkyl vinyl imidazolium, alkyl vinyl pyridinium, alkyl vinyl pyrrolidone salts.

Other suitable cationic polymers for use in the compositions include copolymers of 1-vinyl-2-pyrrolidone and 1-vinyl-3-methylimidazolium salt (e.g., chloride salt) (referred to in the industry by the Cosmetic, Toiletry, and Fragrance Association, "CTFA", as Polyquaternium-16); copolymers of 1-vinyl-2-pyrrolidone and dimethylaminoethyl methacrylate (referred to in the industry by CTFA as Polyquaternium-11); cationic diallyl quaternary ammonium-containing polymers, including, for example, dimethyldiallyl ammonium chloride homopolymer, copolymers of acrylamide and dimethyldiallylammonium chloride (referred to in the industry by CTFA as Polyquaternium-6 and Polyquaternium-7, respectively); amphoteric copolymers of acrylic acid including copolymers of acrylic acid and dimethyldiallylammonium chloride (referred to in the industry by CTFA as Polyquaternium-22), terpolymers of acrylic acid with dimethyldiallylammonium chloride and acrylamide (referred to in the industry by CTFA as Polyquaternium-39), and terpolymers of acrylic acid with methacrylamidopropyl trimethylammonium chloride and methylacrylate (referred to in the industry by CTFA as Polyquaternium-47). Suitable cationic substituted monomers are the cationic substituted dialkylaminoalkyl acrylamides, dialkylaminoalkyl methacrylamides, and combinations thereof. These suitable monomers conform to the formula (III):

Formula (III)

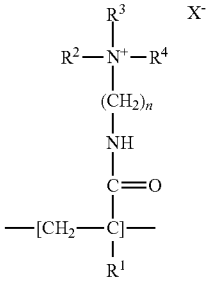

wherein $R^1$ of formula (III) is hydrogen, methyl or ethyl; each of $R^2$, $R^3$, and $R^4$ of formula (III) are independently hydrogen or a short chain alkyl having from about 1 to about 8 carbon atoms, typically from about 1 to about 5 carbon atoms, commonly from about 1 to about 2 carbon atoms; n of formula (III) is an integer having a value of from about 1 to about 8, typically from about 1 to about 4; and X of formula (III) is a water soluble counterion such as a halide. The nitrogen attached to $R^2$, $R^3$, and $R^4$ of formula (III) may be a protonated amine (primary, secondary, or tertiary), but is typically a quaternary ammonium wherein each of $R^2$, $R^3$, and $R^4$ of formula (III) are alkyl groups, a non-limiting example of which is polymethyacrylamidopropyl trimonium chloride, available under the trade name POLYCARE® 133, from Rhone-Poulenc, Cranberry, N.J., U.S.A.

Other suitable cationic polymers for use in the composition include polysaccharide polymers, such as cationic cellulose derivatives and cationic starch derivatives. Suitable cationic polysaccharide polymers include those which conform to the formula (IV):

Formula (IV)

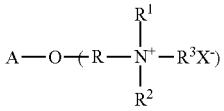

wherein A of formula (IV) is an anhydroglucose residual group, such as a starch or cellulose anhydroglucose residual; R formula (IV) is an alkylene oxyalkylene, polyoxyalkylene, or hydroxyalkylene group, or combination thereof; $R^1$, $R^2$, and $R^3$ formula (IV) independently are alkyl, aryl, alkylaryl, arylalkyl, alkoxyalkyl, or alkoxyaryl groups, each group containing up to about 18 carbon atoms, and the total number of carbon atoms for each cationic moiety (i.e., the sum of carbon atoms in $R^1$, $R^2$, and $R^3$ formula (IV)) typically being about 20 or less; and X formula (IV) is an anionic counterion such as a halide.

Generally, such cellulose or guar cationic deposition polymers may be present at a concentration from about 0.05 wt % to about 5 wt %, by weight of the resulting cleaning composition. Suitable cellulose or guar cationic deposition polymers have a molecular weight of greater than about 5,000. Additionally, such cellulose or guar polymers have a charge density from about 0.5 meq/g to about 4.0 meq/g at the pH of intended use of the personal care composition, which pH will generally range from about pH 3 to about pH 9, preferably between about pH 4 and about pH 8. The pH of the compositions is measured neat.

In one embodiment, the cationic polymers are derivatives of Hydroxypropyl Guar, examples of which include polymers known via the INCI nomenclature as Guar Hydroxypropyltrimonium Chloride, such as the products sold under the name CATINAL CG-100, CATINAL CG-200 by the company Toho, COSMEDIA GUAR C-261N, COSMEDIA GUAR C-261N, COSMEDIA GUAR C-261N by the company Cognis, DIAGUM P 5070 by the company Freedom Chemical Diamalt, N-HANCE Cationic Guar by the company Hercules/Aqualon, HI-CARE 1000, JAGUAR C-17, JAGUAR C-2000, JAGUAR C-13S, JAGUAR C-14S, JAGUAR EXCEL by the company Rhodia, KIPROGUM CW, KIPROGUM NGK by the company Nippon Starch. Suitable cationic cellulose polymers are salts of hydroxyethyl cellulose reacted with trimethyl ammonium substituted epoxide, referred to in the industry (CTFA) as Polyquaternium 10 and available from Amerchol Corp. (Edison, N.J., USA) in their Polymer LR, JR, and KG series of polymers. Other suitable types of cationic cellulose includes the polymeric quaternary ammonium salts of hydroxyethyl cellulose reacted with lauryl dimethyl ammonium-substituted epoxide, referred to in the industry (CTFA) as Polyquaternium 24. These materials are available from Amerchol Corp., under the tradename Polymer LM-200.

Other suitable cationic polymers include cationic guar gum derivatives, such as guar hydroxypropyltrimonium chloride, specific examples of which include the Jaguar series commercially available from Rhone-Poulenc Incorporated and the N-Hance series commercially available from Aqualon Division of Hercules, Inc.

Other suitable cationic polymers include quaternary nitrogen-containing cellulose ethers, some examples of which are described in U.S. Pat. No. 3,962,418. Other suitable cationic polymers include copolymers of etherified cellulose, guar and starch, some examples of which are described in U.S. Pat. No. 3,958,581.

When used, the cationic polymers herein are either soluble in the composition or are soluble in a complex coacervate phase in the composition formed by the cationic polymer and the detersive surfactant components described hereinbefore. Complex coacervates of the cationic polymer can also be formed with other charged materials in the composition.

Deposition Polymers

Deposition polymers useful herein for the aqueous phase may include those discussed in US 2007/0207109 A1 and US 2008/0206185 A1, such as synthetic copolymer of sufficiently high molecular weight to effectively enhance the deposition of the conditioning active components of the personal care composition described herein. Combinations of cationic polymer may also be utilized. The average molecular weight of the synthetic copolymers is generally between about 10,000 and about 10 million, preferably between about 100,000 and about 3 million, still more preferably between about 200,000 and about 2 million.

In a further embodiment, the synthetic copolymers have mass charge densities of from about 0.1 meq/gm to about 6.0 meq/gm and more preferably from about 0.5 meq/gm to about 3.0 meq/gm, at the pH of intended use of the cleaning composition. The pH will generally range from about pH 3 to about pH 9, and more preferably between about pH 4 and about pH 8.

In yet another embodiment, the synthetic copolymers have linear charge densities from at least about 2 meq/A to about 500 meq/A, and more preferably from about 20 meq/A to about 200 meq/A, and most preferably from about 25 meq/A to about 100 meq/A.

Cationic polymer may be copolymers or homopolymers. In one embodiment, a homopolymer is utilized in the present composition. In another embodiment, a copolymer is utilized in the present composition. In another embodiment a mixture of a homopolymer and a copolymer is utilized in the present composition. In another embodiment, a homopolymer of a naturally derived nature, such as cellulose or guar polymer discussed herein, is combined with a homopolymer or copolymer of synthetic origin, such as those discussed below.

Homopolymers—Non-crosslinked cationic homopolymers of the following monomers are also useful herein: 3-acrylamidopropyltrimethylammonium chloride (APTAC), diallyldimethylammonium chloride (DADMAC), [(3-methylacrylolyamino)propyl]trimethylammonium chloride (MAPTAC), 3-methyl-1-vinylimidazolium chloride (QVI); [2-(acryloyloxy)ethyl]trimethylammonium chloride and [2-(acryloyloxy)propyl]trimethylammonium chloride.

Copolymers—copolymer may be comprises of two cationic monomer or a nonionic and cationic monomers.

Nonionic Monomer Unit

A copolymer suitable for use herein comprises a nonionic monomer unit represented by the following Formula V:

I.

Formula (V)

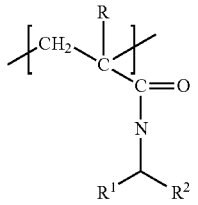

where R of formula (V) is H or $C_{1-4}$ alkyl; and $R^1$ and $R^2$ of formula (V) are independently selected from the group consisting of H, $C_{1-4}$ alkyl, $CH_2OCH_3$, $CH_2OCH_2CH(CH_3)_2$, and phenyl, or together are $C_{3-6}$ cycloalkyl.

In one embodiment, nonionic monomer unit is acrylamide (AM), i.e., where R, $R^1$, and $R^2$ of formula (V) are H as shown below in formula (VI):

Formula (VI)

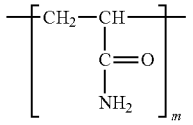

where m is equal to 1.

Another preferred nonionic monomer unit is methacrylamide (MethAM), i.e., where R of formula (V) is $C_1$ alkyl, and $R^1$ and $R^2$ of formula (V) are each H:

Formula (VII)

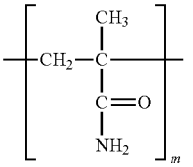

where m is equal to 1.

However, the other acrylamide derivatives within the scope of the formula set out above are also contemplated to be suitable where polyacrylamide and copolymers using acrylamide monomers are useful.

The nonionic monomer portion of the copolymer may be present in an amount from about 50 wt % to about 99.5 wt % by weight of the total copolymer. Preferably, this amount is from about 70 wt % to about 99 wt %, still more preferably from about 80 wt % to about 99 wt % by weight of copolymer.

Cationic Monomer Unit

The copolymers may also comprise a cationic monomer unit represented by Formula (VIII):

Formula (VIII)

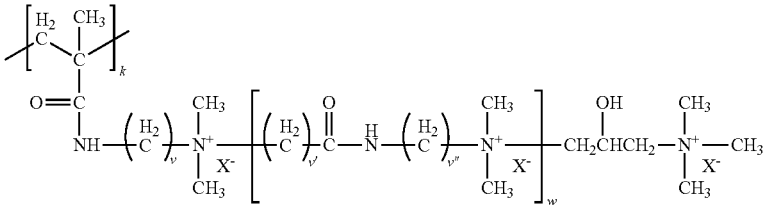

where k of formula (VIII) is 1, each of v, v', and v" of formula (VIII) is independently an integer of from 1 to 6, w of formula (VIII) is zero or an integer of from 1 to 10, and $X^-$ of formula (VIII) is a water soluble anion such as a halide.

In one embodiment, a structure is present where k=1, v=3 and w=0 and $X^-$ is $Cl^-$ according to formula (VIII), above, to form the following structure:

Formula (IX)

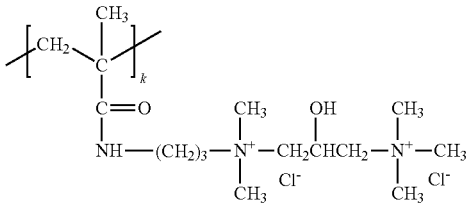

The above structure may be referred to as diquat.

Yet another embodiment is achieved by the structure formed wherein k=1, v and v" are each 3, v'=1, w=1, and $X^-$ is $Cl^-$ according to formula (VIII), such as:

Formula (X)

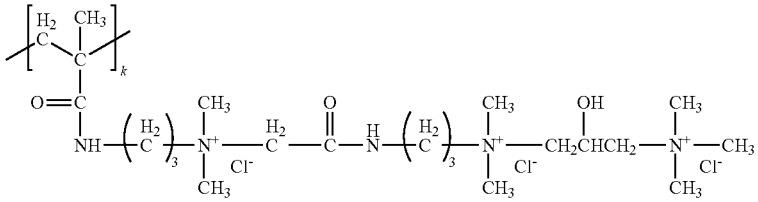

The above structure may be referred to as triquat.

Suitable cationic monomers can be made by, for example, the methods described in U.S. Patent Application Publication No. 2004/0010106 A1.

Polymer Thickener

According to the present invention, the liquid cleaning compositions may comprise a polymer thickener, comprising at least one polymer selected from associative polymers, polysaccharides, non-associative polycarboxylic polymers, and mixtures thereof.

Those skilled in the art will recognize that polymer thickening systems usually provide thickening by chain entanglement, network formation or micro-gel swelling. These systems usually have gel appearance and feel and are thus strongly desirable.

Preferable associative polymeric thickeners for use herein comprise at least one hydrophilic unit which is unsaturated carboxylic acid or its derivative, and at least one hydrophobic unit which is a $C_8$ to $C_{30}$ alkyl ester or oxyethylenated $C_8$-$C_{30}$ alkyl ester of unsaturated carboxylic acid. The unsaturated carboxylic acid is preferably acrylic acid, methacrylic acid or itaconic acid. Examples can be made of material sold under trade name ACULY-22 by the company Rohm & Haas, materials sold under trade names PERMULEN TR1, CARBOPOL 2020, CARBOPOL ULTREZ-21 by the company Noveon, and materials sold under the trade names STRUCTURE 2001 and STRUCTURE 3001 by the company National Starch. Another preferable associative polymer for use in the polymer thickening systems of the present invention include polyether polyurethane, for example materials sold under the trade name ACULYN-44 and ACULYN-46 by the company Rohm and Haas. Another preferable associative polymer for use herein is cellulose modified with groups comprising at least one $C_8$-$C_{30}$ fatty chain, such as the product NATROSOL PLUS GRADE 330 CS sold by the company Aqualon.

Non-associative cross-linked polycarboxylic polymers for use herein can be chosen, for example, from:

(i) cross-linked acrylic acid homopolymers;

(ii) copolymers of acrylic or (meth)acrylic acid and of $C_1$-$C_6$ alkyl acrylate or (meth)acrylate.

Preferable polymers are the products sold under the names CARBOPOL 980, 981, 954, 2984, 5984 by the company Noveon or the products sold under the names SYNTHALEN M, SYNTHALEN L and SYNTHALEN K by the company 3V Sigma, or the product sold under the name ACULYN-33 by the company Rohm and Haas.

The polysaccharides for use herein are, for example, chosen from glucans, modified and unmodified starches (such as those derived, for example, from cereals, for instance wheat, corn or rice, from vegetables, for instance yellow pea, and tubers, for instance potato or cassaya), amylose, amylopectin, glycogen, dextrans, celluloses and derivatives thereof (methylcelluloses, hydroxyalkylcelluloses, ethyl hydroxyethylcelluloses, and carboxymethylcelluloses), mannans, xylans, lignins, arabans, galactans, galacturonans, chitin, chitosans, glucuronoxylans, arabinoxylans, xyloglucans, glucomannans, pectic acids and pectins, alginic acid and alginates, arabinogalactans, carrageenans, agars, glycosaminoglucans, gum arabics, gum tragacanths, ghatti gums, karaya gums, carob gums, galactomannans, such as guar gums, and non-ionic derivatives thereof (hydroxypropyl guar) and bio-polysaccharides, such as xanthan gums, gellan gums, welan gums, scleroglucans, succinoglycans and mixtures thereof.

For example, suitable polysaccharides are described in "Encyclopedia of Chemical Technology", Kirk-Othmer, Third Edition, 1982, volume 3, pp. 896-900, and volume 15, pp. 439-458, in "Polymers in Nature" by E. A. MacGregor and C. T. Greenwood, published by John Wiley & Sons, Chapter 6, pp. 240-328, 1980, and in "Industrial Gums—Polysaccharides and their Derivatives", edited by Roy L. Whistler, Second Edition, published by Academic Press Inc.

The polysaccharide is preferably a bio-polysaccharide, particularly preferable are bio-polysaccharides selected from xanthan gum, gellan gum, welan gum, scleroglucan or succinoglycan, for example material sold under the name KELTROL® T by the company Kelco and the material sold by the name RHEOZAN® by the company Rhodia Chimie.

Another preferable polysaccharide is hydroxypropyl starch derivative, particularly preferable hydroxypropyl starch phosphate, for example the material sold under the name STRUCTURE XL® by the company National Starch.

Co-Surfactants

Co-surfactants are suitable materials for the aqueous phase and are selected to enhance lather volume and/or to modify lather texture of the cleaning compositions. Typically these materials can be selected from a variety of families of structures including, but not limited to, amphoteric, zwitterionic, cationic, and nonionic.

The cleaning composition resulting from the process herein may comprise from about 0.5 wt % to about 10 wt %, alternatively from about 0.5 wt % to about 5 wt %, and alternatively from about 1 wt % to about 3 wt % by weight of the composition of at least one suitable co-surfactant.

Amphoteric surfactants suitable for use herein include, but are not limited to derivatives of aliphatic secondary and tertiary amines in which the aliphatic radical can be straight or branched chain and wherein one substituent of the aliphatic substituents contains from about 8 to about 18 carbon atoms and one contains an anionic water solubilizing group, e.g., carboxy, sulfonate, sulfate, phosphate, or phosphonate. Examples include sodium 3-dodecyl-aminopropionate, sodium 3-dodecylaminopropane sulfonate, sodium lauryl sarcosinate, N-alkyltaurines such as the one prepared by reacting dodecylamine with sodium isethionate according to the teaching of U.S. Pat. No. 2,658,072, N-higher alkyl aspartic acids such as those produced according to the teaching of U.S. Pat. No. 2,438,091, and the products described in U.S. Pat. No. 2,528,378, and mixtures thereof. The family of amphoacetates derived from the reaction of sodium chloroacetate with amidoamines to produce alkanoyl amphoacetates are particularly effective, e.g. lauryolamphoacetate, and the like.

Zwitterionic surfactants suitable for use herein include, but are not limited to derivatives of aliphatic quaternary ammonium, phosphonium, and sulfonium compounds, in which the aliphatic radicals can be straight or branched chain, and wherein one of the aliphatic substituents contains from about 8 to about 18 carbon atoms and one substituent contains an anionic group, e.g., carboxy, sulfonate, sulfate, phosphate, or phosphonate. Other zwitterionic surfactants suitable for use herein include betaines, including high alkyl betaines such as coco dimethyl carboxymethyl betaine, cocoamidopropyl betaine, cocobetaine, lauryl amidopropyl betaine, oleyl betaine, lauryl dimethyl carboxymethyl betaine, lauryl dimethyl alphacarboxyethyl betaine, cetyl dimethyl carboxymethyl betaine, lauryl bis-(2-hydroxyethyl) carboxymethyl betaine, stearyl bis-(2-hydroxypropyl) carboxymethyl betaine, oleyl dimethyl gamma-carboxypropyl betaine, lauryl bis-(2-hydroxypropyl)alpha-carboxyethyl betaine, and mixtures thereof. The sulfobetaines may include coco dimethyl sulfopropyl betaine, stearyl dimethyl sulfopropyl betaine, lauryl dimethyl sulfoethyl betaine, lauryl bis-(2-hydroxyethyl) sulfopropyl betaine and mixtures thereof. Also suitable zwitterionic surfactants include amidobetaines and amidosulfobetaines, wherein the $RCONH(CH_2)_3$ radical, wherein R is a $C_{11}$-$C_{17}$ alkyl, is attached to the nitrogen atom of the betaine are also useful in this application.

Nonionic co-surfactants typically used in the cleaning composition for enhancing lather volume or texture include water soluble materials like lauryl dimethylamine oxide, cocodimethylamine oxide, cocoamidopropylamine oxide, laurylamidopropyl amine oxide, etc. or alkylpolyethoxylates like laureth-4 to laureth-7 and water insoluble components such as cocomonoethanol amide, cocodiethanol amide, lauroylmonoethanol amide, alkanoyl isopropanol amides, and fatty alcohols like cetyl alcohol and oleyl alcohol, and 2-hydroxyalkyl methyl ethers, etc.

Further suitable materials as co-surfactants herein include 1,2-alkylepoxides, 1,2-alkanediols, branched or straight chain alkyl glyceryl ethers (e.g., as disclosed in EP 1696023A1), 1,2-alkylcyclic carbonates, and 1,2-alkyl cyclicsulfites, particularly those wherein the alkyl group contains 6 to 14 carbon atoms in linear or branched configuration. Other examples include the alkyl ether alcohols derived from reacting $C_{10}$ or $C_{12}$ alpha olefins with ethylene glycol (e.g., hydroxyethyl-2-decyl ether, hydroxyethyl-2-dodecyl ether), as can be made according to the teachings of U.S. Pat. No. 5,741,948; U.S. Pat. No. 5,994,595; U.S. Pat. No. 6,346,509; and U.S. Pat. No. 6,417,408.

Other preferred nonionic surfactants may be selected from the group consisting of glucose amides, alkyl polyglucosides, sucrose cocoate, sucrose laurate, alkanolamides, ethoxylated alcohols and mixtures thereof. In one embodiment the nonionic surfactant is selected from the group consisting of glyceryl monohydroxystearate, isostearet-2, trideceth-3, hydroxystearic acid, propylene glycol stearate, PEG-2 stearate, sorbitan monostearate, glyceryl laurate, laureth-2, cocamide monoethanolamine, lauramide monoethanolamine, and mixtures thereof.

In a particular embodiment, the co-surfactant is selected from the group consisting of cocomonoethanol amide, cocoamidopropyl betaine, laurylamidopropyl betaine, cocobetaine, lauryl betaine, lauryl amine oxide, sodium lauryl amphoacetate; alkyl glyceryl ethers, alkyl-di-glyceryl ethers, 1,2-alkyl cyclic sulfites, 1,2-alkyl cyclic carbonates, 1,2-alkyl-epoxides, alkyl glycidylethers, and alkyl-1,3-dioxolanes, wherein the alkyl group contains 6 to 14 carbon atoms in linear or branched configuration; 1,2-alkane diols where the total carbon content is from 6 to 14 carbon atoms linear or branched; methyl-2-hydroxy-decyl ethers, hydroxyethyl-2-dodecyl ether, hydroxyethyl-2-decyl ether, and mixtures thereof.

Cationic surfactants may be derived from amines that are protonated at the pH of the formulation, e.g. bis-hydroxyethyl lauryl amine, lauryl dimethylamine, lauroyl dimethyl amidopropyl amine, cocoylamidopropyl amine, and the like. The cationic surfactants may also be derived from fatty quaternary ammonium salts such as lauryl trimethylammonium chloride and lauroylamidopropyl trimethyl ammonium chloride.

Conditioning Agent

The aqueous phase may comprise a conditioning agent, and in some embodiments at least about 0.05 wt % by weight of the cleaning compositions of a conditioning agent. In particular embodiments, the cleaning composition comprises from about 0.05 wt % to about 10 wt % by weight of the cleaning compositions conditioning agent, and in other embodiments from about 0.05 wt % to about 2 wt % by weight of the cleaning compositions, in alternate embodiments from about 0.5 wt % to about 10 wt % by weight of the cleaning compositions of a conditioning agent, and in still other embodiments from about 0.5 wt % to about 6 wt % by weight of the cleaning compositions of a conditioning agent.

Conditioning agents can include, for example, large and small particle silicone (e.g., small particle silicone of less than 0.1 microns), and oils.

Silicones

The conditioning agent of the cleaning compositions is typically an insoluble, non-volatile silicone conditioning agent. The silicone conditioning agent particles may comprise volatile silicone, non-volatile silicone, or combinations thereof. The silicone conditioning agent particles may comprise a silicone fluid conditioning agent and may also comprise other ingredients, such as a silicone resin, to improve silicone fluid deposition efficiency. The skilled practitioner will recognize that the particle size of silicones (particle size diameter from about 0.005 μm to about 50 μm) or other water-immiscible liquids in the final composition could be controlled by varying the energy input into the present invention's high-shear device via changes in the flow ratio, or alternatively, by control of the mixing energy after the completion of the dilution of the lamellar surfactant.

Non-limiting examples of suitable silicone conditioning agents, and optional suspending agents for the silicone, are described in U.S. Reissue Pat. No. 34,584, U.S. Pat. No. 5,104,646, and U.S. Pat. No. 5,106,609. The silicone conditioning agents for use in the compositions of the present application generally have a viscosity, as measured at 25° C., from about 20 to about 2,000,000 centistokes ("csk"), typically from about 1,000 to about 1,800,000 csk, commonly from about 50,000 to about 1,500,000 csk, typically from about 100,000 to about 1,500,000 csk.

Optional Ingredients

Anti-Dandruff Actives—The aqueous phase may also contain an anti-dandruff agent. Suitable, non-limiting examples of anti-dandruff particulates include: pyridinethione salts, zinc-containing layered material, azoles, such as ketoconazole, econazole, and elubiol, selenium sulfide, particulate sulfur, salicylic acid and mixtures thereof. A typical anti-dandruff particulate is pyridinethione salt. Such anti-dandruff particulate should be physically and chemically compatible with the components of the composition, and should not otherwise unduly impair product stability, aesthetics or performance.

Additional anti-microbial actives may be present in the aqueous phase and may include extracts of melaleuca (tea tree) and charcoal. The present application may also comprise combinations of anti-microbial actives. Such combinations may include octopirox and zinc pyrithione combinations, pine tar and sulfur combinations, salicylic acid and zinc pyrithione combinations, elubiol and zinc pyrithione combinations, elubiol and salicylic acid combinations, octopirox and climbasole combinations, and salicylic acid and octopirox combinations, and mixtures thereof.

Furthermore, additional components which may be present in the aqueous phase may include sugar amines (e.g., N-acetylglucosamine), vitamin $B_3$ compounds, sodium dehydroacetate, dehydroacetic acid and its salts, phytosterols, soy derivatives (e.g., equol and other isoflavones), niacinamide, phytantriol, farnesol, bisabolol, salicylic acid compounds, hexamidines, dialkanoyl hydroxyproline compounds, N-acyl amino acid compounds, retinoids (e.g., retinyl propionate), water-soluble vitamins, ascorbates (e.g., vitamin C, ascorbic acid, ascorbyl glucoside, ascorbyl palmitate, magnesium ascorbyl phosphate, sodium ascorbyl phosphate), particulate materials, sunscreen actives, butylated hydroxytoluene, butylated hydroxyanisole, their derivatives, and combinations thereof dyes, nonvolatile solvents or diluents (water soluble and insoluble), pearlescent aids, foam boosters, pediculocides, pH adjusting agents, perfumes, particles (e.g., organic, inorganic) preservatives, chelants, chelating agents, proteins, UV absorbers, pigments, other amino acids, and other vitamins.

For instance, the aqueous phase of the present application may comprise one or more vitamins and/or amino acids such as: water soluble vitamins such as vitamin $B_1$, $B_2$, $B_6$, $B_{12}$, C, pantothenic acid, pantothenyl ethyl ether, panthenol, biotin, and their derivatives, water soluble amino acids such as asparagine, alanine, glutamic acid and their salts, water insoluble vitamins such as vitamin A, D, E, and their derivatives, water insoluble amino acids such as tyrosine, tryptophan, and their salts.

Furthermore, the composition can comprise other peptides, such as those disclosed in U.S. Pat. No. 6,492,326, issued Dec. 10, 2002, to Robinson et al. (e.g., pentapeptides such as lys-thr-thr-lys-ser, and derivatives thereof). Suitable pentapeptide derivatives include palmitoyl-lys-thr-thr-lys-ser, available from Sederma, France. Another optional dipeptide that can be used in the composition herein is carnosine. As used herein, the term "peptide" is broad enough to include one or more peptide, one or more peptide derivatives, and combinations thereof.

Any other suitable optional component can also be included in the personal care composition of the present application, such as those ingredients that are conventionally used in given product types. The CTFA Cosmetic Ingredient Handbook, Tenth Edition (published by the Cosmetic, Toiletry, and Fragrance Association, Inc., Washington, D.C.) (2004) (hereinafter "CTFA"), describes a wide variety of nonlimiting materials that can be added to the composition herein.

EXAMPLES

The following example will illustrate the invention. The desired cleaning composition is as follows:

TABLE 1

| Ingredient | Sodium laureth-3 sulfate[1] | Sodium laureth-1 sulfate[2] | Cocamido propyl betaine | Fragrance | Sodium benzoate | Disodium EDTA | Guar hydroxy propyl trimonium*[3] | water |
|---|---|---|---|---|---|---|---|---|
| Active level in comp | 13.4% | 12.4% | 2.72% | 1% | 0.28% | 0.16% | 0.14% | — |
| Activity of raw material | 28% | 25% | 30% | 100% | 100% | 100% | 100% | — |
| As-added % of composition | 47.86% | 49.6% | 9.07% | 1% | 0.28% | 0.16% | 0.14% | 8.11% |

*Some polymers, particularly highly cationic ones, are preferably hydrated in water before contact with surfactant. For the present example, we will conservatively assume the polymer does not need to be pre-hydrated before addition to the composition.

[1]ex Stepan Matamoros, MX

[2]ex Stepan Matamoros, MX

[3]ex Rhodia Vernon, TX

TABLE 2

| Ingredient | Sodium laureth-3 sulfate[1] | Sodium laureth-1 sulfate[2] | Cocamido propyl betaine | Fragrance | Sodium benzoate | Disodium EDTA | Guar hydroxy propyl trimonium*[3] | water |
|---|---|---|---|---|---|---|---|---|
| Active level in comp | 13.4% | 12.4% | 2.72% | 1% | 0.28% | 0.16% | 0.14% | — |

TABLE 2-continued

| Ingredient | Sodium laureth-3 sulfate[1] | Sodium laureth-1 sulfate[2] | Cocamido propyl betaine | Fragrance | Sodium benzoate | Disodium EDTA | Guar hydroxy propyl trimonium*[3] | water |
|---|---|---|---|---|---|---|---|---|
| Activity of raw material | 28% | 70% | 30% | 100% | 100% | 100% | 100% | — |
| As-added % of composition | 47.86% | 17.71% | 9.07% | 1% | 0.28% | 0.16% | 0.14% | +23.78% |

*Some polymers, particularly highly cationic ones, are preferably hydrated in water before contact with surfactant. For the present example, we will conservatively assume the polymer does not need to be pre-hydrated before addition to the composition.
[1]ex Stepan Matamoros, MX
[2]ex Stepan Matamoros, MX
[3]ex Rhodia Vernon, TX In conventional processing, the sodium laureth-1 sulfate (SLE1S) would be either added as a pre-diluted 25% active material, or diluted to ~25% active in-situ prior to addition of the other ingredients. (The analysis is similar if the SLE3S or an SLE1S/SLE3S blend is used in the high-active form rather than the SLE1S material.) However, it is obvious from the above table 1 that this approach would require removal of water (8.11 wt %) from the formula after making, which is clearly undesirable on an industrial scale. Furthermore, there would be no water available for the preferred pre-dispersion of the polymeric and preservative solids. On the contrary, if the present process is used, there is plenty of water available (23.78%), and several additions can occur quickly in a low-viscosity environment, prior to the introduction of lamellar 70% SLE1S.

The MFR for the above system is not the simple ratio of 1.8 for the dilution of 70% SLE1S to 25%. For the purposes of illustration, all ingredients except for the 70% SLE1S and the fragrance will be considered as part of the aqueous phase prior to introduction of SLE1S, reserving the fragrance as a later addition for preferred operational logistics. The proper ratios/amounts of guar hydroxypropyltrimonium, disodium EDTA, sodium benzoate, cocamidopropyl betaine, and SLE3S were sequentially added to water in a 100-kg tank with a simple overhead mixer. After 30 minutes of mixing at ambient temperature (20-25° C.), this aqueous phase was pumped at 11.2 kg/min with a Moyno FB progressive-cavity pump into a tee upstream of an 18-element, 15-mm diameter SMX static mixer (Sulzer Chemtech, Switzerland). The second phase into the tee upstream of the SMX was the 70% SLE1S, also at ambient temperature (20-25° C.), pumped from a Waukesha 015U2 rotary lobe pump at various flow rates to change the flow ratio inside the high-shear device. The resulting compositions (see table below) exiting the mixer were allowed to rest for one day, and were then measured rheologically using a 40 mm, 2-degree cone/plate system on a TA Instruments AR2000 at 25 C. A shear rate of 1/sec is applied for 2 minutes, and the average viscosity over the final 20 seconds is recorded as the final viscosity.

TABLE 3

| kg/min aqueous | kg/min SLE1S | flow ratio | viscosity Pa-s |
|---|---|---|---|
| 11.2 | 1.34 | 8.36 | 1.9 |
| 11.2 | 2.40 | 4.67 | 5.7 |
| 11.2 | 2.79 | 4.01 | 10.0 |
| 11.2 | 3.32 | 3.37 | 59 |
| 11.2 | 3.9 | 2.87 | 137 |
| 11.2 | 4.7 | 2.38 | 226 |

From the table, it is clear that the MFR for this composition is between 2.8 and 3.4, where as the desired composition stipulates a maximum flow ratio of 4.67, proving that the composition can be made with the present process. The composition in row 2 of Table 3 was completed with 1 fragrance in a tank downstream of the high-shear device to make the final product.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for making a liquid cleaning composition comprising combining an aqueous phase comprising water and at least one other component and a surfactant-containing lamellar phase, where such combining would ordinarily form a highly viscous mesophase having a viscosity of at least 100 Pa-s, the process avoiding said mesophase by:

a) providing the aqueous phase comprising water and at least one other component selected from anionic surfactants, amphoteric surfactants, zwitterionic surfactants, nonionic surfactants, conditioning polymers, deposition polymers, and thickening polymers;

b) providing the surfactant-containing lamellar phase wherein the lamellar phase comprises from about 50% to 80% active surfactant(s); and c) combining the aqueous phase with the lamellar phase in a high shear device at a flow ratio of the aqueous phase to lamellar phase of from 1 to 3 of the Minimum Flow Ratio, wherein the Minimum Flow Ratio is the lowest ratio of aqueous phase to lamellar phase that maintains the viscosity of the resulting composition at less than 100 Pa-s at a shear rate of 1/sec;

wherein the lamellar phase is eliminated via dissolution into the aqueous phase such that a liquid cleaning composition results; and wherein the liquid cleaning composition has a viscosity of less than 100 Pa-s at a shear rate of 1/sec.

2. A process for making a liquid cleaning composition comprising combining an aqueous phase comprising water and at least one other component and a surfactant-containing lamellar phase, where such combining would ordinarily form a highly viscous mesophase, the process avoiding said mesophase by:

a) determining the Minimum Flow Ratio of aqueous phase to lamellar phase by determining the lowest ratio of aqueous phase to lamellar phase that maintains the viscosity of the resulting composition at less than 100 Pa-s at a shear rate of 1/sec;

b) providing the aqueous phase comprising water and at least one other component selected from anionic surfactants, amphoteric surfactants, zwitterionic surfactants, nonionic surfactants, conditioning polymers, deposition polymers, and thickening polymers;

c) providing the surfactant-containing lamellar phase wherein the lamellar phase comprises from about 50% to 80% active surfactant(s); and d) combining, in a high shear device, the aqueous phase with the lamellar phase at an aqueous phase to lamellar phase ratio of from 1 to 3 of the Minimum Flow Ratio;

whereby the lamellar phase is eliminated via dissolution into the aqueous phase to provide the liquid cleaning composition.

3. The process of claim 1 wherein the viscosity of the aqueous phase into the high shear device is 0.004 to 40 Pa-s at a shear rate of 1/sec.

4. The process of claim 1 wherein the viscosity of the liquid cleaning composition is between about 2 and about 100 Pa-s at a shear rate of 1/sec and a temperature of 25 C.

5. The process of claim 1 wherein the surfactant in a lamellar phase is sodium or ammonium laureth sulfate, with an ethoxy moiety per molecule of 0.7 to 3.0.

6. The process of claim 1 wherein the aqueous phase comprises water and a conditioning polymer.

7. The process of claim 1 wherein the process is done in a single pass.

8. The process of claim 1 wherein the high-shear device is a dynamic (rotating) mixer, containing one or more high-shear zones inside the mixer, with the minimum dimension in at least one zone of about 0.1 mm to about 20 mm.

9. The process of claim 8 wherein the dynamic mixer has a tip speed of 5 to 50 meters per second.

10. The process of claim 1 wherein the high-shear device is a static mixer, wherein the static mixer is a mixing device whose energy dissipation results naturally from the flow of the material into the device.

11. The process of claim 10 wherein the energy imparted per unit of fluid passing through the device is 10 to 10,000 J/kg.

12. The process of claim 1 wherein the process further comprises the step of adding at least one shear-sensitive adjunct to the liquid cleaning composition base.

13. The process of claim 2 wherein the viscosity of the aqueous phase into the high shear device is 0.004 to 40 Pa-s at a shear rate of 1/sec.

14. The process of claim 2 wherein the viscosity of the liquid cleaning composition is between about 2 and about 100 Pa-s at a shear rate of 1/sec and a temperature of 25 C.

15. The process of claim 2 wherein the surfactant in a lamellar phase is sodium or ammonium laureth sulfate, with an ethoxy moiety per molecule of 0.7 to 3.0.

16. The process of claim 2 wherein the aqueous phase comprises water and a conditioning polymer.

17. The process of claim 2 wherein the process further comprises the step of adding at least one shear-sensitive adjunct to the liquid cleaning composition base.

* * * * *